US009027525B2

(12) United States Patent
Almhagen

(10) Patent No.: US 9,027,525 B2
(45) Date of Patent: May 12, 2015

(54) ENGINE START ASSIST SYSTEM

(75) Inventor: Petter Almhagen, Floda (SE)

(73) Assignee: Volvo Car Corporation (SE)

( * ) Notice: Subject to any disclaimer, the term of this patent is extended or adjusted under 35 U.S.C. 154(b) by 339 days.

(21) Appl. No.: 13/609,847

(22) Filed: Sep. 11, 2012

(65) Prior Publication Data

US 2013/0239921 A1 Sep. 19, 2013

(30) Foreign Application Priority Data

Sep. 12, 2011 (EP) ..... 11180895

(51) Int. Cl.
*F02N 11/00* (2006.01)
*F02N 11/08* (2006.01)

(52) U.S. Cl.
CPC ..... *F02N 11/00* (2013.01); *F02N 11/0866* (2013.01); *F02N 2011/0885* (2013.01); *F02N 2250/02* (2013.01); *F02N 2300/2002* (2013.01)

(58) Field of Classification Search
CPC . F02N 11/0837; F02N 11/0866; F02N 11/14; F02N 2250/02; F02N 2011/0885
USPC ..... 123/179.3, 179.4, 179.28; 701/112, 113
See application file for complete search history.

(56) References Cited

U.S. PATENT DOCUMENTS 4,412,137 A 10/1983 Hansen et al.
5,668,461 A 9/1997 Hancock et al.
7,216,617 B2 5/2007 Tanaka et al.
7,336,002 B2 * 2/2008 Kato et al. ..... 307/10.6
7,690,343 B2 * 4/2010 Doljack ..... 123/179.28
8,039,976 B2 * 10/2011 Sato et al. ..... 290/40 C
2011/0208410 A1 8/2011 Izumoto et al.
2012/0330538 A1 * 12/2012 Spjuth et al. ..... 701/113

FOREIGN PATENT DOCUMENTS

EP 1595748 A1 11/2005
EP 2065268 A1 6/2009

OTHER PUBLICATIONS

European Search Report Dated Feb. 17, 2012, Application No. 11180895.2-2311, Applicant Volvo Car Corporation, 6 Pages.

* cited by examiner

*Primary Examiner* — Hai Huynh
(74) *Attorney, Agent, or Firm* — Brooks Kushman P.C.

(57) ABSTRACT

An arrangement and a method are provided for improving performance of a start assist system for an internal combustion engine of a vehicle comprising: a start/stop system, a primary source of electrical energy, a secondary source of electrical energy, an electrical starter motor, an engine control unit, and additional vehicle electrical loads. A start controller is arranged such that the starter motor and engine control unit are operable with power supplied from the primary source of electrical energy at an initial cold starting attempt. If reset of the engine control unit occurs during the first cold starting attempt, the start controller is arranged such that the starter motor is operable with power supplied from the primary source of electrical energy and the engine control unit is operable with power supplied from the secondary source of electrical energy for an additional cold starting attempt.

19 Claims, 2 Drawing Sheets

ENGINE START ASSIST SYSTEM

CROSS-REFERENCE TO RELATED APPLICATIONS

This application claims foreign priority benefits under 35 U.S.C. §119(a)-(d) to EP 11180895.2, filed Sep. 12, 2011, the disclosure of which is incorporated in its entirety by reference herein.

TECHNICAL FIELD

Embodiments herein relate to an arrangement for improving the performance of an electrical engine start assist system of a vehicle. In particular they relate to an arrangement for improving the performance of an electrical engine start assist system of a vehicle having an internal combustion engine provided with a start/stop system.

Embodiments herein further relate to a method for improving the performance of an electrical engine start assist system of a vehicle. In particular they relate to a method for improving the performance of an electrical engine start assist system of a vehicle having an internal combustion engine provided with a start/stop system.

BACKGROUND

So called start/stop systems are becoming increasingly common in vehicles having internal combustion engines. These systems have a proven ability to provide fuel savings, especially during city driving. This is due to a shutoff of the internal combustion engine when not required to propel the vehicle and a restart thereof once required again.

Some start/stop vehicles have two batteries. When starting in a start/stop mode, i.e., a warm start following a shutoff of the internal combustion engine, e.g., during a stop at an intersection, one main battery supplies the starter motor while a second battery supplies the vehicle systems with electric current. However, when starting using a key, starter button or similar, i.e., so called cold start, the main battery supplies both the vehicle systems and the starter motor.

However, a problem associated with the supply of electric current to vehicle systems is that some of these systems comprise components which are critical for starting of the internal combustion engine of the vehicle, such as an Engine Control Unit (ECU)/Engine Control Module (ECM) and injector valves etc. Some of these start critical components require a voltage above a certain threshold voltage, e.g., of about 6V, in order to operate as required.

The battery performance, i.e., capability to keep the voltage above the threshold voltage at a specified current drain, is both due to State of Charge (SOC) and some ageing factors, e.g., the battery capacity, where the capacity is continuously reduced during the battery service life, and the battery internal resistance, which is increasing during battery service life.

When the main battery performance is reduced by any of above listed reasons, there is a range where the main battery power will suffice to enable the starter motor to crank the internal combustion engine. However, the main battery power may at the same time be insufficient to maintain the voltage at a sufficiently high level for keeping the ECU/ECM and possibly other start critical systems operating as required for starting.

In order to mitigate this problem of draining of a vehicle starter battery one known solution, according to U.S. Pat. No. 7,216,617, aims to provide an engine starting assisting system capable of starting an engine even if an engine ECU is reset as the battery voltage becomes less than a reset level when starting the engine. The system includes an auxiliary ECU having a voltage booster, an engine ECU, a starter relay, and a starter that allows the engine to be started when a current flows through the starter relay. The auxiliary ECU and the engine ECU are powered by the starter battery and supply current to the starter relay. When the engine ECU resets the supply of the current to the starter relay because of a voltage drop of the starter battery during starting of the engine, the auxiliary ECU increases the voltage supplied from the starter battery using the booster, thereby supplying requisite current to the starter relay, whereby the engine can be started.

However, such a known arrangement will have a limited ability to compensate fully for reduced performance of the main battery.

SUMMARY

Embodiments herein aim to provide an improved arrangement and method for improving the performance of a start assist system for an internal combustion engine of a vehicle comprising a start/stop system.

This is achieved by an arrangement further comprising: a primary source of electrical energy; a secondary source of electrical energy; an electrical starter motor; an engine control unit; and additional vehicle electrical loads, which still further comprises a start controller arranged such that the starter motor and engine control unit are operable with power supplied from the primary source of electrical energy at an initial cold starting attempt and such that, if reset of the engine control unit occurs during the first cold starting attempt, the starter motor is operable with power supplied from the primary source of electrical energy and the engine control unit is operable with power supplied from the secondary source of electrical energy for an additional cold starting attempt.

The provision of a start controller arranged as above promotes startability in a situation where the primary source of electrical energy is suffering from reduced performance such that the power is sufficient for the starter motor to crank the internal combustion engine, but otherwise insufficient for maintaining a sufficient voltage level for avoiding reset of the engine control unit According to a second aspect the start controller is further arranged such that any additional electrically powered start critical components among the additional vehicle electrical loads, normally operable with power supplied from the primary source of electrical energy, at an initial cold starting attempt, if reset of the engine control unit occurs during the first cold starting attempt, are operable with power supplied from the secondary source of electrical energy for an additional cold starting attempt.

The provision of power supply from the secondary source of electrical energy to any additional electrically powered start critical components for an additional cold starting attempt, as described for the second aspect, further promotes startability in a situation where the primary source of electrical energy is suffering from reduced performance.

According to a third aspect the start controller is further arranged such that electrically powered injector valves of the internal combustion engine, normally operable with power supplied from the primary source of electrical energy, at an initial cold starting attempt, if reset of the engine control unit occurs during the first cold starting attempt, are operable with power supplied from the secondary source of electrical energy for an additional cold starting attempt.

The provision of power supply from the secondary source of electrical energy to electrically powered injector valves of the internal combustion engine for an additional cold starting attempt, as described for the third aspect, still further promotes startability in a situation where the primary source of electrical energy is suffering from reduced performance.

According to a fourth aspect the second source of electrical energy is a lithium ion battery.

According to a fifth aspect the second source of electrical energy is a super capacitor.

A lithium ion battery or super capacitor as the second source of electrical energy, as described for the fourth or fifth aspect, provides rechargeable sources of electrical energy particularly suited for maintaining voltage levels to start critical components even when a primary source of electrical energy, such as a lead acid battery, of a vehicle having an internal combustion engine provided with a start/stop system is suffering from reduced performance.

The method provides for the same advantages as described above for aspects of the arrangement.

BRIEF DESCRIPTION OF THE DRAWINGS

In the following, embodiments herein will be described in greater detail by way of example only with reference to attached drawings, in which.

Still other objects and features of embodiments herein will become apparent from the following detailed description considered in conjunction with the accompanying drawings. It is to be understood, however, that the drawings are designed solely for purposes of illustration and not as a definition of the limits hereof, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
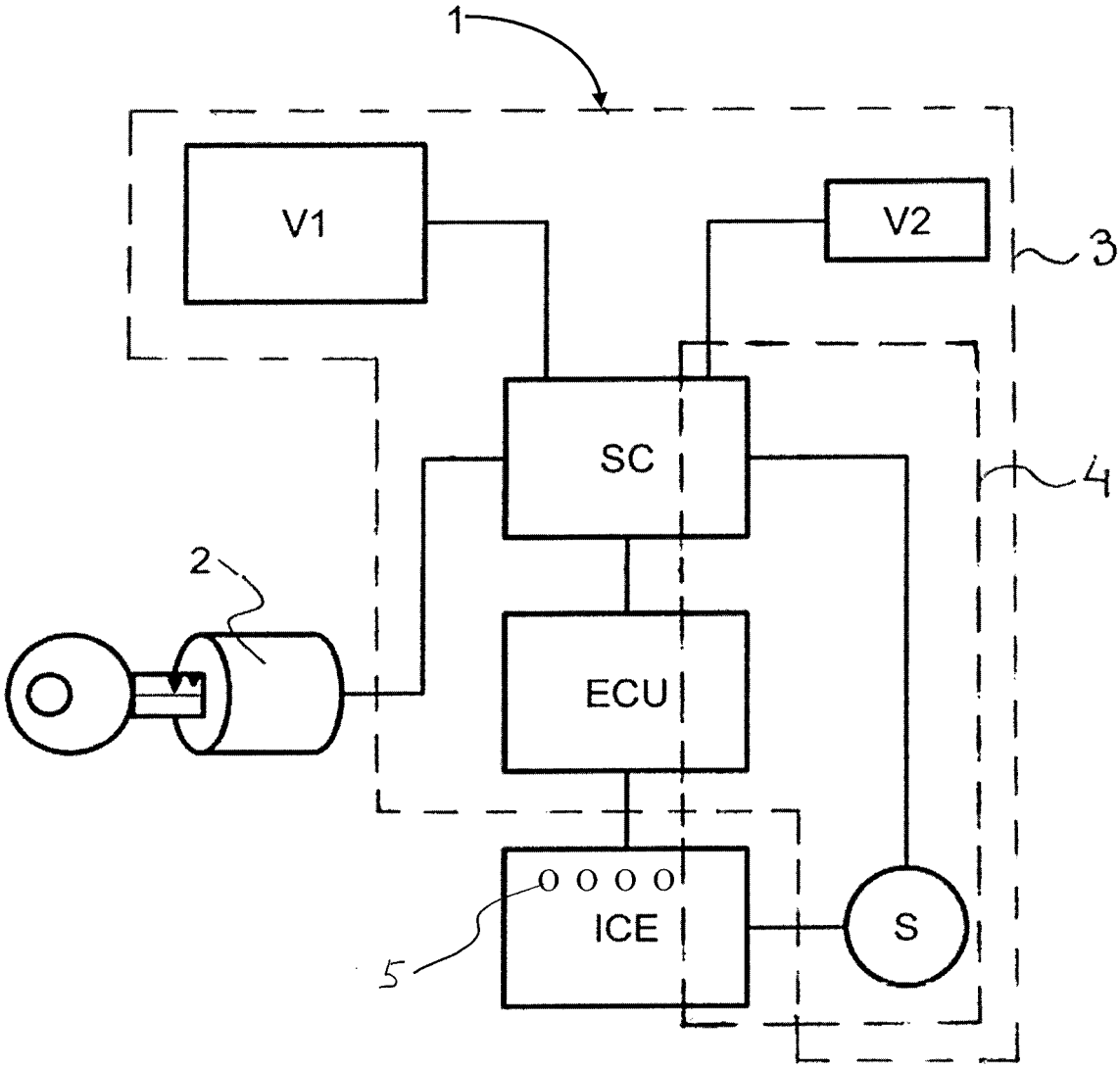
FIG. 1 is a schematic diagram of a first embodiment of an arrangement for improving the performance of a start assist system for an internal combustion engine of a vehicle comprising a start/stop system.

In overview, embodiments herein, as shown schematically in FIG. 1, relate to an arrangement 1 for improving the performance of a start assist system for an internal combustion engine ICE of a vehicle when the voltage of a primary source of electrical energy V1 is low, e.g., in a situation where the primary source of electrical energy V1 is suffering from reduced performance.

The arrangement is especially intended to provide improved performance when a driver of the vehicle attempts starting of the internal combustion engine ICE with the key or start button 2, i.e., a so called first start or cold start of the internal combustion engine ICE.

The arrangement especially relates to an arrangement for improving the performance of an electrical engine start assist system of a vehicle having an internal combustion engine ICE provided with a start/stop system and having two sources of electrical energy, e.g., a primary battery and a support battery.

The arrangement 1 thus comprises: a start/stop system 4, a primary source of electrical energy V1; a secondary source of electrical energy V2; an electrical starter motor S; an engine control unit ECU, also called Engine Control Module (ECM); and additional vehicle electrical loads.

According to a first embodiment the arrangement further comprises a start controller SC. The start controller SC is arranged such that the starter motor S and engine control unit ECU are operable with power supplied from the primary source of electrical energy V1 at an initial cold starting attempt.

The start controller SC is further arranged such that, if reset of the engine control unit ECU occurs during the first cold starting attempt, the starter motor S is operable with power supplied from the primary source of electrical energy V1 and the engine control unit ECU is operable with power supplied from the secondary source of electrical energy V2 for an additional cold starting attempt.

According to a further embodiment the start controller SC is arranged such that any additional electrically powered start critical components among the additional vehicle electrical loads, normally operable with power supplied from the primary source of electrical energy V1, at an initial cold starting attempt, if reset of the engine control unit ECU occurs during the first cold starting attempt, are operable with power supplied from the secondary source of electrical energy V2 for an additional cold starting attempt.

According to yet further embodiments the start controller SC is arranged such that electrically powered injector valves 5 of the internal combustion engine, normally operable with power supplied from the primary source of electrical energy V1, at an initial cold starting attempt, if reset of the engine control unit ECU occurs during the first cold starting attempt, are operable with power supplied from the secondary source of electrical energy V2 for an additional cold starting attempt.

According to a still further embodiment the second source of electrical energy V2 is a lithium ion battery. In an alternative embodiment the second source of electrical energy V2 is a super capacitor. Both the super capacitor and the lithium ion battery are suitable for high energy throughput.

The present application also provides a method for improving the performance of a start assist system 3 for an internal combustion engine ICE of a vehicle. The start assist system 3 further comprising: a start/stop system 4, a primary source of electrical energy V1; a secondary source of electrical energy V2; an electrical starter motor S; an engine control unit ECU; and additional vehicle electrical loads.

According to a first embodiment the method comprises firstly the step of arranging a start controller SC such that the starter motor S and engine control unit ECU are operable with power supplied from the primary source of electrical energy V1 at an initial cold starting attempt.

Secondly, the method according to the first embodiment comprises the additional step that, if reset of the engine control unit ECU occurs during the first cold starting attempt, the starter motor S is operable with power supplied from the primary source of electrical energy V1 and the engine control unit ECU is operable with power supplied from the secondary source of electrical energy V2 for an additional cold starting attempt.

In one embodiment of the method it further comprises the step of further arranging the start controller SC such that any additional electrically powered start critical components among the additional vehicle electrical loads, normally operable with power supplied from the primary source of electrical energy V1, at an initial cold starting attempt, if reset of the engine control unit ECU occurs during the first cold starting attempt, are operable with power supplied from the secondary source of electrical energy V2 for an additional cold starting attempt.

In an alternative embodiment of the method it further comprises the step of further arranging the start controller SC such that electrically powered injector valves 5 of the internal combustion engine, normally operable with power supplied from the primary source of electrical energy V1, at an initial cold starting attempt, if reset of the engine control unit ECU occurs during the first cold starting attempt, are operable with power supplied from the secondary source of electrical energy V2 for an additional cold starting attempt.

In a yet further embodiment of the method it further comprises the step of arranging as the second source of electrical energy V2 a lithium ion battery.

In a still yet further embodiment of the method it further comprises the step of arranging as the second source of electrical energy V2 a super capacitor.

Figure 2:
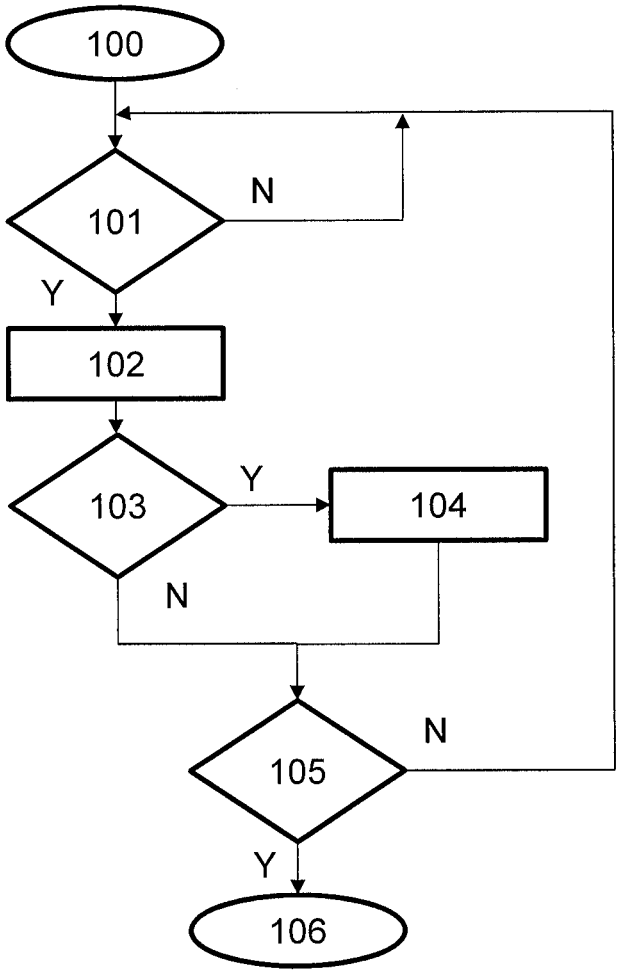
FIG. 2 is a schematic flow chart illustrating operation of the arrangement according to FIG. 1 for improving the performance of a start assist system for an internal combustion engine of a vehicle comprising a start/stop system.

A schematic flow chart illustrating operation of the arrangement for improving the performance of a start assist system for an internal combustion engine of a vehicle comprising a start/stop system is shown in FIG. 2.

Operation starts at 100 where after it is decided in step 101 if a start command is issued by a driver of the vehicle, e.g., from a start key or button 2.

If decided that a start command is issued in step 101 the start controller SC performs step 102 of making the starter motor S and engine control unit ECU operable with power supplied from the primary source of electrical energy V1 and triggers an initial cold starting attempt.

In step 103 it is decided if reset of the engine control unit ECU occurs during the first cold starting attempt.

If decided that no reset of the engine control unit ECU occurs during the first cold starting attempt a determination if starting of the internal combustion engine ICE is achieved is performed as step 105.

If determined in step 105 that starting of the internal combustion engine ICE has been achieved the starting process is terminated at step 106, otherwise the process is reset to wait for a renewed start command.

If, however, it is decided in step 103 that reset of the engine control unit ECU occurs during the first cold starting attempt, the start controller SC performs the additional step 104 of making the starter motor S operable with power supplied from the primary source of electrical energy V1 and the engine control unit ECU operable with power supplied from the secondary source of electrical energy V2 and triggers an additional cold starting attempt.

Thereafter a determination if starting of the internal combustion engine ICE is achieved is performed as step 105.

If determined in step 105 that starting of the internal combustion engine ICE has been achieved the starting process is terminated at step 106, otherwise the process is reset to wait for a renewed start command.

In accordance with the present application is also envisaged a vehicle comprising an arrangement as described above.

The above-described embodiments may be varied within the scope of the following claims.

Thus, while there have been shown and described and pointed out fundamental novel features of the embodiments herein, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are equivalent. Moreover, it should be recognized that structures and/or elements and/or method steps shown and/or described in connection with any disclosed form or embodiment herein may be incorporated in any other disclosed or described or suggested form or embodiment as a general matter of design choice.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An arrangement for improving the performance of a start assist system for an internal combustion engine of a vehicle, the arrangement comprising:

a start/stop system;

a primary source of electrical energy;

a secondary source of electrical energy;

an electrical starter motor;

an engine control unit; and a start controller arranged such that the starter motor and engine control unit are operable with power supplied from the primary source of electrical energy at an initial cold starting attempt and such that, if reset of the engine control unit occurs during the initial cold starting attempt, the starter motor is operable with power supplied from the primary source of electrical energy and the engine control unit is operable with power supplied from the secondary source of electrical energy for an additional cold starting attempt.

2. An arrangement according to claim 1 further comprising an additional electrically powered component used in starting the engine, wherein the start controller further is arranged such that the additional electrically powered component, normally operable with power supplied from the primary source of electrical energy, at an initial cold starting attempt, if reset of the engine control unit occurs during the first cold starting attempt, is operable with power supplied from the secondary source of electrical energy for an additional cold starting attempt.

3. An arrangement according to claim 1 wherein the internal combustion engine comprises electrically powered injector valves, and wherein the start controller further is arranged such that the electrically powered injector valves, normally operable with power supplied from the primary source of electrical energy, at an initial cold starting attempt, if reset of the engine control unit occurs during the first cold starting attempt, are operable with power supplied from the secondary source of electrical energy for an additional cold starting attempt.

4. An arrangement according to claim 1 wherein the second source of electrical energy comprises a lithium ion battery.

5. An arrangement according to claim 1 wherein the second source of electrical energy comprises a super capacitor.

6. A vehicle comprising an arrangement according to claim 1.

7. The arrangement according to claim 1 wherein the initial cold starting attempt involves use of a key or a starter button.

8. A method for improving the performance of a start assist system for an internal combustion engine of a vehicle including a start/stop system, a primary source of electrical energy, a secondary source of electrical energy, an electrical starter motor, and an engine control unit, the method comprising:

arranging a start controller such that the starter motor and the engine control unit are operable with power supplied from the primary source of electrical energy at an initial cold starting attempt, and such that, if reset of the engine control unit occurs during the initial cold starting attempt, the starter motor is operable with power supplied from the primary source of electrical energy and the engine control unit is operable with power supplied from the secondary source of electrical energy for an additional cold starting attempt.

9. A method according to claim 8 further comprising arranging the start controller such that an additional electrically powered component used in starting the engine, normally operable with power supplied from the primary source of electrical energy, at an initial cold starting attempt, if reset of the engine control unit occurs during the first cold starting attempt, is operable with power supplied from the secondary source of electrical energy for an additional cold starting attempt.

10. A method according to claim 8 further comprising arranging the start controller such that electrically powered injector valves of the internal combustion engine, normally operable with power supplied from the primary source of electrical energy, at an initial cold starting attempt, if reset of the engine control unit occurs during the first cold starting attempt, are operable with power supplied from the secondary source of electrical energy for an additional cold starting attempt.

11. A method according to claim 8 further comprising providing a lithium ion battery as the second source of electrical energy.

12. A method according to claim 8 further comprising providing a super capacitor as the second source of electrical energy.

13. The method according to claim 8 wherein the initial cold starting attempt involves use of a key or a starter button.

14. An arrangement for starting an internal combustion engine of a vehicle, the arrangement comprising:

a primary source of electrical energy;

a secondary source of electrical energy;

an electric starter motor for starting the internal combustion engine;

an engine control unit; and a start controller configured for use in supplying power to the starter motor and the engine control unit such that the starter motor and the engine control unit are supplied power from the primary source of electrical energy at an initial cold starting attempt and such that, if reset of the engine control unit occurs during the initial cold starting attempt, the starter motor is supplied power from the primary source of electrical energy and the engine control unit is supplied power from the secondary source of electrical energy for an additional cold starting attempt.

15. The arrangement according to claim 14 further comprising an additional electrically powered component used in starting the engine, wherein the start controller is further configured for use in supplying power to the additional electrically powered component such that the additional electrically powered component, normally supplied with power from the primary source of electrical energy, at an initial cold starting attempt, if reset of the engine control unit occurs during the first cold starting attempt, is supplied power from the secondary source of electrical energy for an additional cold starting attempt.

16. The arrangement according to claim 14 wherein the internal combustion engine comprises electrically powered injector valves, and wherein the start controller is further configured for use in supplying power to the injector valves such that the injector valves, normally operable with power supplied from the primary source of electrical energy, at an initial cold starting attempt, if reset of the engine control unit occurs during the first cold starting attempt, are operable with power supplied from the secondary source of electrical energy for an additional cold starting attempt.

17. The arrangement according to claim 14 wherein the second source of electrical energy comprises a lithium ion battery.

18. The arrangement according to claim 14 wherein the second source of electrical energy comprises a super capacitor.

19. The arrangement according to claim 14 wherein the initial cold starting attempt involves use of a key or a starter button.

* * * * *